US011751289B2

(12) United States Patent
Ptasienski et al.

(10) Patent No.: US 11,751,289 B2
(45) Date of Patent: Sep. 5, 2023

(54) INTEGRATED HEATER AND METHOD OF MANUFACTURE

(71) Applicant: Watlow Electric Manufacturing Company, St. Louis, MO (US)

(72) Inventors: Kevin Ptasienski, O'Fallon, MO (US); Patrick Margavio, Columbia, MO (US); Kevin Smith, Columbia, MO (US)

(73) Assignee: WATLOW ELECTRIC MANUFACTURING COMPANY, St. Louis, MO (US)

( * ) Notice: Subject to any disclaimer, the term of this patent is extended or adjusted under 35 U.S.C. 154(b) by 0 days.

(21) Appl. No.: 17/338,229

(22) Filed: Jun. 3, 2021

(65) Prior Publication Data

US 2021/0298125 A1 Sep. 23, 2021

Related U.S. Application Data

(63) Continuation of application No. 15/986,441, filed on May 22, 2018, now Pat. No. 11,083,050, which is a continuation-in-part of application No. 15/819,028, filed on Nov. 21, 2017, now Pat. No. 10,681,778.

(51) Int. Cl.
*H05B 3/18* (2006.01)
*H05B 3/28* (2006.01)

(52) U.S. Cl.
CPC ..... *H05B 3/18* (2013.01); *H05B 3/283* (2013.01); *H05B 2203/017* (2013.01)

(58) Field of Classification Search
CPC ..... H05B 3/18
USPC ..... 29/611, 612, 610; 338/25
See application file for complete search history.

(56) References Cited

U.S. PATENT DOCUMENTS

| | | | | |
|---|---|---|---|---|
| 7,594,317 | B2 | 9/2009 | Nakamura | |
| 8,912,613 | B2 | 12/2014 | Lee et al. | |
| 10,720,346 | B2 | 7/2020 | Singh et al. | |
| 11,083,050 | B2 * | 8/2021 | Ptasienski | H05B 3/18 |
| 11,091,397 | B2 * | 8/2021 | Elliot | B23K 1/19 |

(Continued)

FOREIGN PATENT DOCUMENTS

| | | |
|---|---|---|
| CN | 1980541 A | 6/2007 |
| JP | H05275434 A | 10/1993 |

(Continued)

OTHER PUBLICATIONS

Office Action issued in Chinese Application No. 201980045343.0 dated Aug. 11, 2021, 6 pages.

(Continued)

*Primary Examiner* — Lori L Baker
(74) *Attorney, Agent, or Firm* — Burris Law, PLLC

(57) ABSTRACT

A heater includes a sintered assembly and a functional element disposed on one of opposing surfaces of the sintered assembly. The heater is manufactured by a method that includes hot pressing a ceramic powder and a plurality of first slugs and forming the sintered assembly including a ceramic substrate and the plurality of first slugs embedded therein, forming the functional element on the one opposing surface of the sintered assembly such that the functional element is connected to the plurality of first slugs, and forming a monolithic substrate in which the functional element and the plurality of first slugs are embedded.

20 Claims, 12 Drawing Sheets

(56) References Cited

U.S. PATENT DOCUMENTS

| | | | | |
|---|---|---|---|---|
| 2005/0056976 | A1 | 3/2005 | Matsuda et al. | |
| 2006/0102613 | A1 | 5/2006 | Kuibira et al. | |
| 2010/0243635 | A1 | 9/2010 | Nakamura et al. | |
| 2018/0332669 | A1 | 11/2018 | Kuchimachi | |
| 2021/0084719 | A1* | 3/2021 | Margavio | C04B 37/023 |
| 2021/0199345 | A1* | 7/2021 | Everly | H05B 1/0283 |
| 2021/0368584 | A1* | 11/2021 | Breitlow | H05B 1/0227 |
| 2021/0388934 | A1* | 12/2021 | Ohse | F16L 53/38 |
| 2022/0075399 | A1* | 3/2022 | Oplawski | H05B 1/0288 |

FOREIGN PATENT DOCUMENTS

| | | | |
|---|---|---|---|
| JP | H08315965 | | 11/1996 |
| JP | 2000012195 | A | 1/2000 |
| JP | 2010056040 | A | 3/2010 |
| JP | 2012009337 | A | 1/2012 |
| JP | 2012069947 | A | 4/2012 |
| JP | 2015191837 | A | 11/2015 |
| JP | 2017076580 | A | 4/2017 |
| JP | 2019121432 | A | 7/2019 |
| KR | 101397133 | B1 | 5/2014 |
| TW | 444922 | U | 7/2001 |
| WO | 2017081951 | A1 | 5/2017 |

OTHER PUBLICATIONS

English Translation of Notice of Grant issued in corresponding Chinese Application No. 201880085365.5, dated Dec. 14, 2022, 4 pages.

Office Action issued in corresponding DE Application No. 11 2019 002 610.0, dated Jul. 21, 2022, and an English Translation, 8 pages.

Office Action issued in Korean Application No. 1020207036371, dated Aug. 24, 2021, 8 pages.

Office Action issued in Japan Application No. 2020-565268, dated Sep. 7, 2021, 7 pages.

* cited by examiner

INTEGRATED HEATER AND METHOD OF MANUFACTURE

CROSS-REFERENCE TO RELATED APPLICATIONS

This application is a continuation application of U.S. Ser. No. 15/986,441, filed on May 22, 2018, which is a continuation-in-part application of U.S. Ser. No. 15/819,028, filed Nov. 21, 2017 and titled "Integrated Heater and Method of Manufacture." The disclosures of the above-referenced applications are incorporated herein by reference.

FIELD

The present disclosure relates generally to electric heaters, and more particularly to electric heaters with a more uniform structure and more uniform heating performance and methods of manufacturing same.

BACKGROUND

The statements in this section merely provide background information related to the present disclosure and may not constitute prior art.

Some forms of electric heaters having a layered construction generally include a substrate, a dielectric layer disposed on the substrate, a resistive heating layer disposed on the dielectric layer, and a protective layer disposed on the resistive heating layer. The dielectric layer, the resistive heating layer, and the protective layer may be broadly called "functional layers." One or more of the functional layers of the electric heaters may be in the form of a film by depositing a material onto a surface or a substrate.

On a microscopic scale, a deposited film may have an uneven surface due to existing features or trenches on the substrate surface. A top surface of the deposited film generally undergoes a planarization process in order to flatten the top surface and to provide more uniform performance of the functional layer. However, the planarization process may undesirably remove excessive material from the deposited film, causing the thickness of the final deposited film to deviate from its designed thickness. Moreover, when the deposited film is a dielectric layer with an electrical element embedded therein, the dielectric integrity of the film may be compromised due to the reduced thickness of the dielectric layer, resulting in poor performance of the electric heater.

These issues related to the design and performance of electric heaters is addressed by the present disclosure.

SUMMARY

In one form of the present disclosure, a heater comprising a sintered assembly and a functional element disposed on one of opposing surfaces of the sintered assembly is provided. The heater is manufactured by a method comprising hot pressing a ceramic powder and a plurality of first slugs and forming the sintered assembly including a ceramic substrate and the plurality of first slugs embedded therein, forming the functional element on one of the opposing surfaces of the sintered assembly such that the functional element is connected to the plurality of first slugs, and forming a monolithic substrate in which the functional element and the plurality of first slugs are embedded.

In one variation of this form of the present disclosure, the method further comprises forming a material layer on the other opposing surface of the sintered assembly such that the functional element is connected to the material layer by the plurality of first slugs. In one variation, the material layer is a metal foil.

In another variation, the step of forming the functional element comprises forming at least one trench into one of the opposing surfaces of the sintered assembly and into a part of the plurality of first slugs, and depositing a functional material into the at least one trench to form the functional element such that the functional element is connected to the plurality of first slugs. In one form of this variation, the step of depositing a functional material into the at least one trench comprises depositing the functional material on the one opposing surface of the sintered assembly and into the at least one trench, and removing excess functional material such that the functional material is present only within the at least one trench. The step of removing excess functional material may comprise a process selected from a group consisting of a chemical mechanical planarization/polishing (CMP), etching, and polishing.

In yet another variation, the step of forming the sintered assembly comprises placing the plurality of first slugs in an isostatic press chamber, filling the isostatic press chamber with the ceramic powder, and hot pressing the ceramic powder and the plurality of first slugs to form the sintered assembly.

In a further variation, the step of forming the monolithic substrate comprises placing the sintered assembly in an isostatic hot press chamber, placing at least one of additional ceramic powder and a sintered substrate part onto the sintered assembly, and hot pressing the sintered assembly, the functional element, and the at least one of the additional ceramic powder and the sintered substrate part to form the monolithic substrate.

In still another variation, the method further comprises forming a material layer on the other opposing surface of the sintered assembly, the material layer being connected to the plurality of first slugs. The sintered assembly may further include a plurality of second slugs having a smaller length than the plurality of first slugs and the material layer being connected to the plurality of second slugs. Furthermore, the step of forming the monolithic substrate may comprise placing a sintered substrate part in an isostatic hot press chamber, placing the sintered assembly on the sintered substrate part, filling the isostatic hot press chamber with additional ceramic powder such that the sintered assembly is disposed between the additional ceramic powder and the sintered substrate part, and hot pressing the sintered assembly, the functional element, the material layer, the additional ceramic powder and the sintered substrate part to form the monolithic substrate such that the first and second slugs, the functional element, and the material layer are embedded in the monolithic substrate.

The step of forming the monolithic substrate may further comprise placing a mixture of the additional ceramic powder and a sintering aide between the sintered assembly and the sintered substrate part. Additionally, the method may further comprise drilling holes through the monolithic substrate to allow access to the plurality of second slugs. The method may further comprise connecting lead wires to the plurality of second slugs.

In another form of the present disclosure, a heater comprises a sintered assembly with opposing surfaces, a functional element, and a material layer. The heater is manufactured by a method comprising forming the sintered assembly including a ceramic substrate and a plurality of first slugs embedded therein and forming at least one trench into one of the opposing surfaces of the sintered assembly and into a part of the plurality of first slugs. A functional material is deposited into the at least one trench to form the functional element such that the functional element is connected to the plurality of first slugs, the material layer is applied on the other one of the opposing surfaces of the functional element and is connected to the plurality of first slugs, and a monolithic substrate is formed in which the functional element, the plurality of first slugs, and the material layer are embedded.

In one variation of this form of the present disclosure, the sintered assembly further includes a plurality of second slugs having a smaller length than the plurality of first slugs. In another variation, the step of forming the sintered assembly comprises placing the plurality of first slugs and the plurality of second slugs in an isostatic press chamber, filling the isostatic press chamber with ceramic powder, and hot pressing the ceramic powder and the plurality of first slugs and the plurality of second slugs to form the sintered assembly such that the plurality of first slugs and the plurality of second slugs extend along a thickness direction of the sintered assembly.

In still another variation, the method further comprises applying at least one of the ceramic powder and a sintered substrate part on the opposing surfaces of the sintered assembly, and hot pressing the at least one of the ceramic powder and the sintered substrate with the sintered assembly to form the heater with the monolithic substrate.

In a further variation, the method further comprises drilling holes through the monolithic substrate to allow access to the plurality of second slugs. In yet another variation, the method further comprises connecting lead wires to the plurality of second slugs.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

Corresponding reference numerals indicate corresponding parts throughout the several views of the drawings.

DETAILED DESCRIPTION

The following description is merely exemplary in nature and is not intended to limit the present disclosure, application, or uses.

Figure 1:
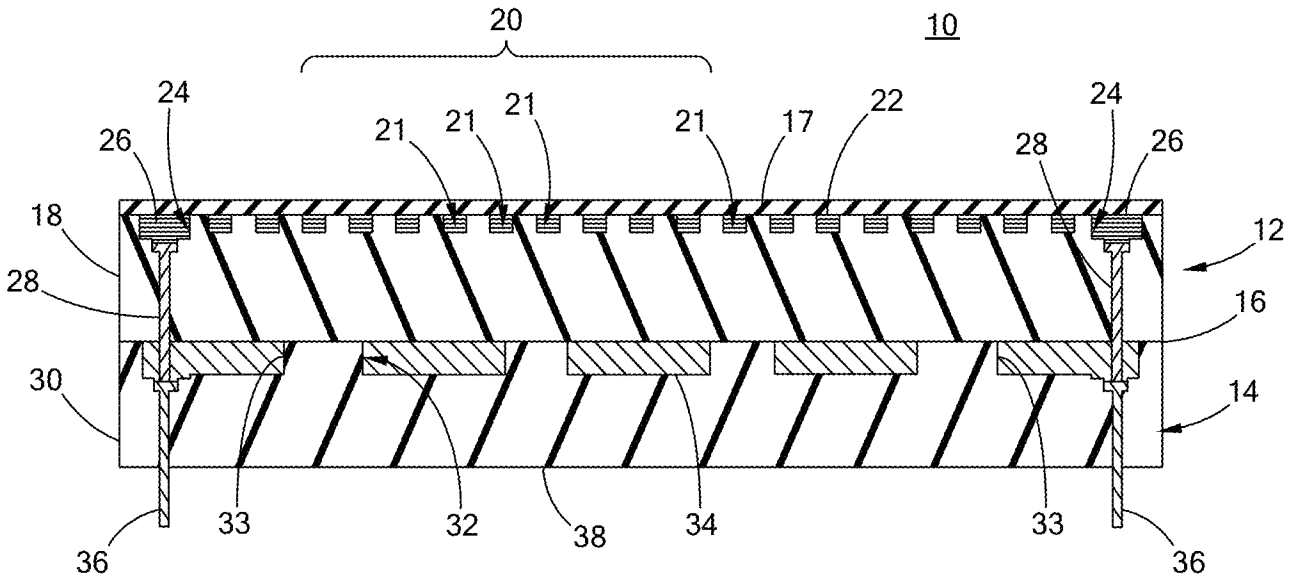
FIG. 1 is a cross-sectional view of an electric heater constructed in accordance with the teachings of the present disclosure.

Referring to FIG. 1, an electric heater 10 constructed in accordance with the teachings of the present disclosure includes a heater layer 12, a routing layer 14, a bonding layer 16 disposed between the heater layer 12 and the routing layer 16, and a protective layer 17 disposed on the heater layer 12. The bonding layer 16 bonds the heater layer 12 to the routing layer 14. The protective layer 17 electrically insulates the heater layer 12.

The heater layer 12 includes a substrate 18 defining at least one trench 20, and at least one resistive heating element 22 disposed in the trench 20. When a plurality of trenches 20 are formed in the substrate 18, a plurality of resistive heating elements 22 may be disposed in the plurality of trenches 20 to define a plurality of heating zones. The trench 20 may define a plurality of first trench sections 21 and at least two second trench sections 24 having an enlarged trench area for electrical termination. The trench 20 defines a depth of about 1 to 10 microns, preferably a depth of about 3 to 5 microns.

The resistive heating element 22 includes at least two terminal pads 26 disposed in the second trench sections 24 having enlarged trench areas. The resistive heating element 22 has a resistive material selected from the group consisting of molybdenum, tungsten, platinum, or alloys thereof. In addition, the resistive material of the resistive heating element 22 may have sufficient temperature coefficient of resistance (TCR) characteristics such that the resistive heating element 22 functions as a heater and as a temperature sensor.

The heater layer 12 further includes a pair of terminal pins 28 in direct contact with the terminal pads 26 of the resistive heating element 22 and extending from the terminal pads 26 through the substrate 18 and the bonding layer 16 to the routing layer 14.

The routing layer 14 includes a substrate 30 defining at least one trench 32, and a routing element 34 disposed in the trench 32. One or more routing elements 34 may be provided depending on applications. The routing element 34 functions to connect the resistive heating elements 22 of the heater layer 12 to an external power source (not shown). The trench 32 of the routing layer 14 may include at least two trench sections 33 corresponding to the second trench sections 24 of the trench 20 of the heater layer 12. The routing layer 14 further includes a pair of terminal pins 36 located in the at least two trench sections 33 and extending from the routing element 34 through the substrate 30 and beyond a lower surface 38 of the substrate 30. The terminal pins 36 of the routing layer 14 are aligned with and in contact with the terminal pins 28 of the heater layer 12.

The substrate 18 of the heater layer 12 and the substrate 30 of the routing layer 14 may include a ceramic material, such as aluminum nitride and aluminum oxide.

Figure 2A:
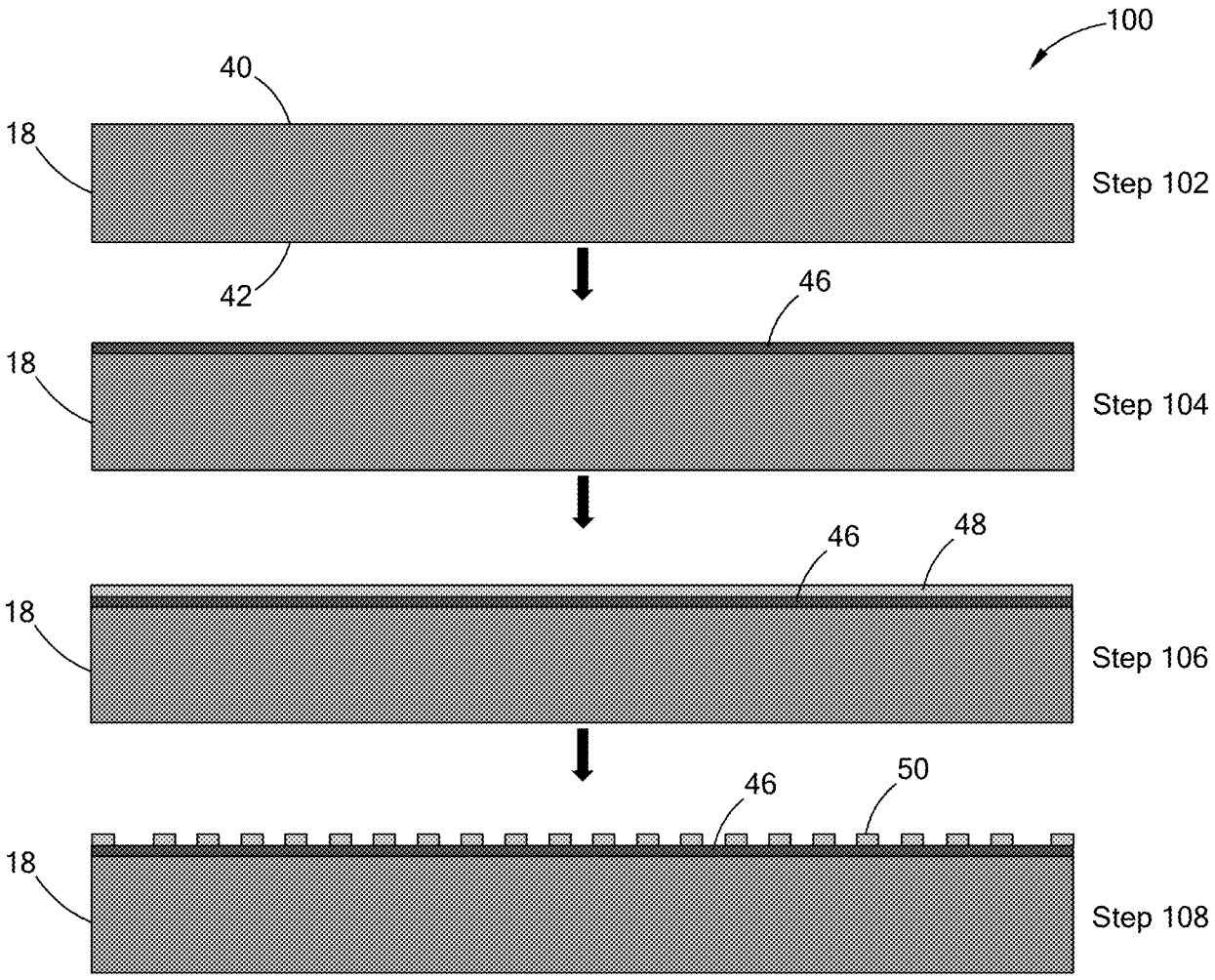
FIG. 2A through 2D are diagrams illustrating steps of manufacturing a heater layer of an electric heater of FIG. 1 in accordance with the teachings of the present disclosure.
Figure 2B:
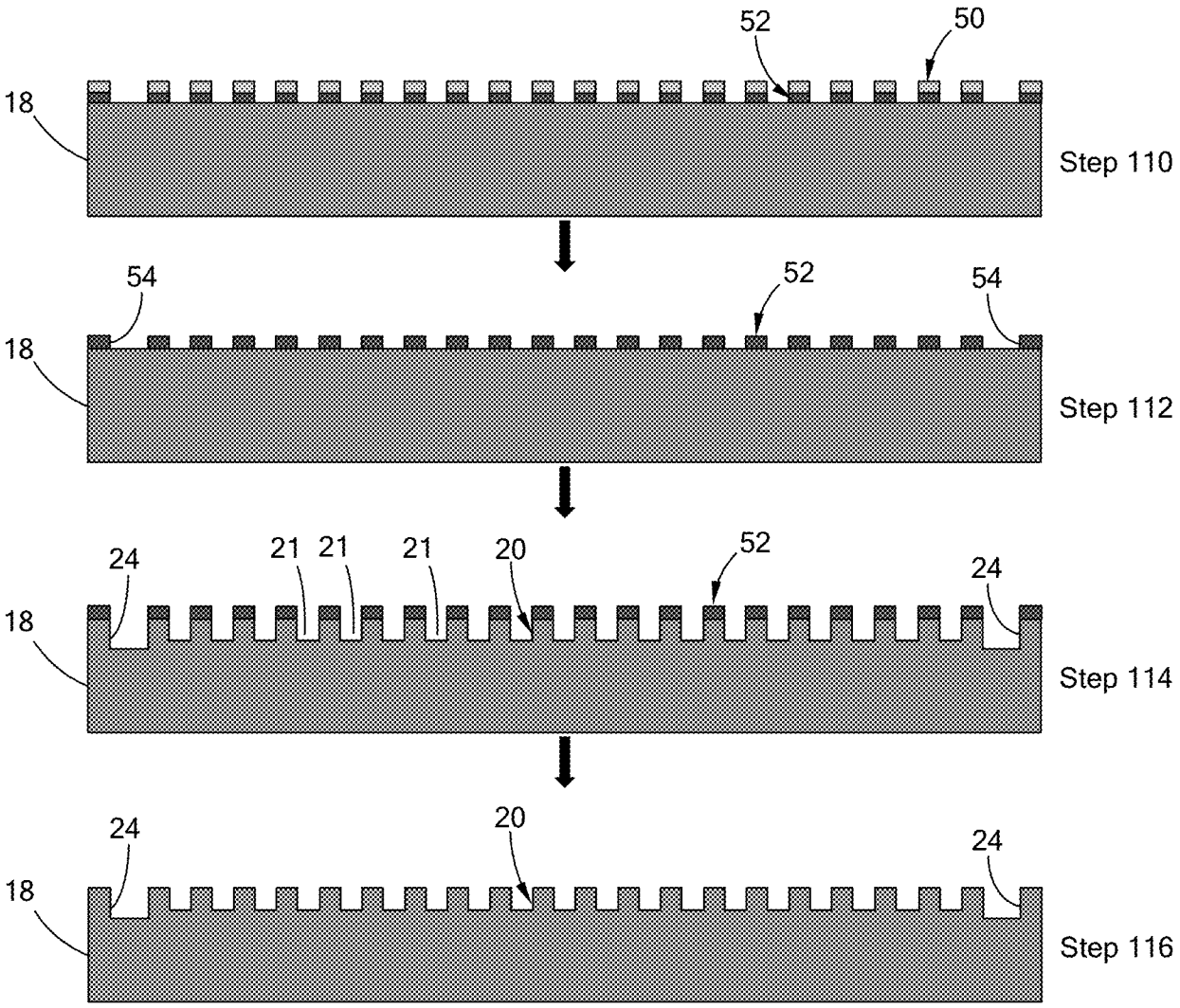
Figure 2C:
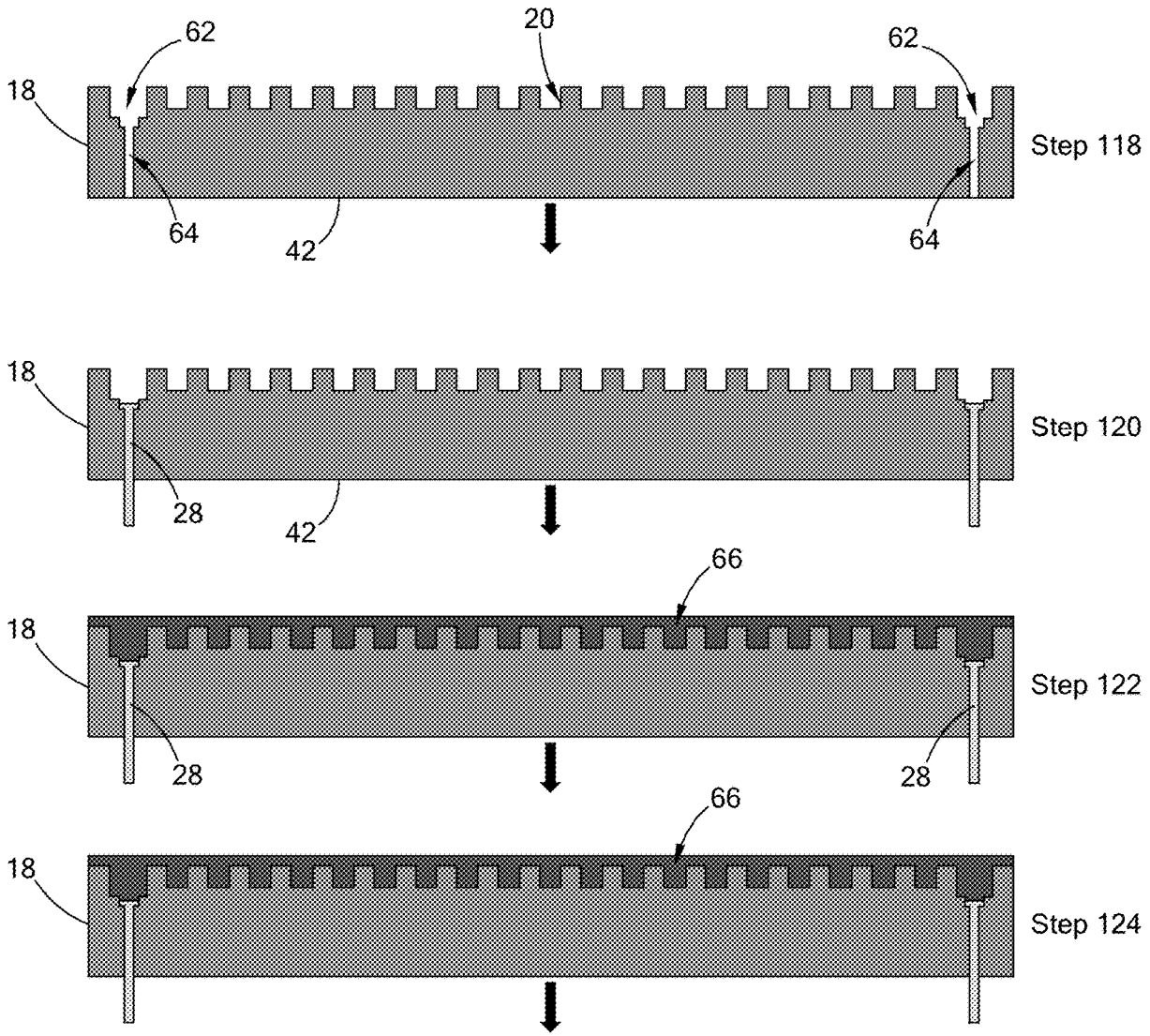
Figure 2D:
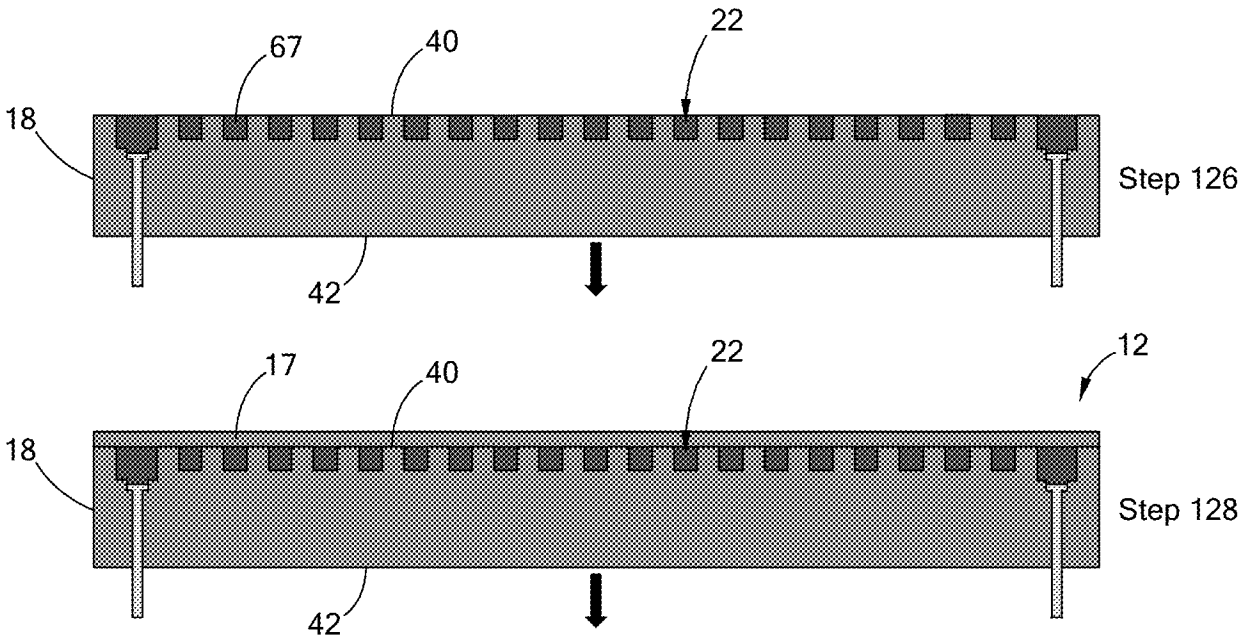
Figure 2E:
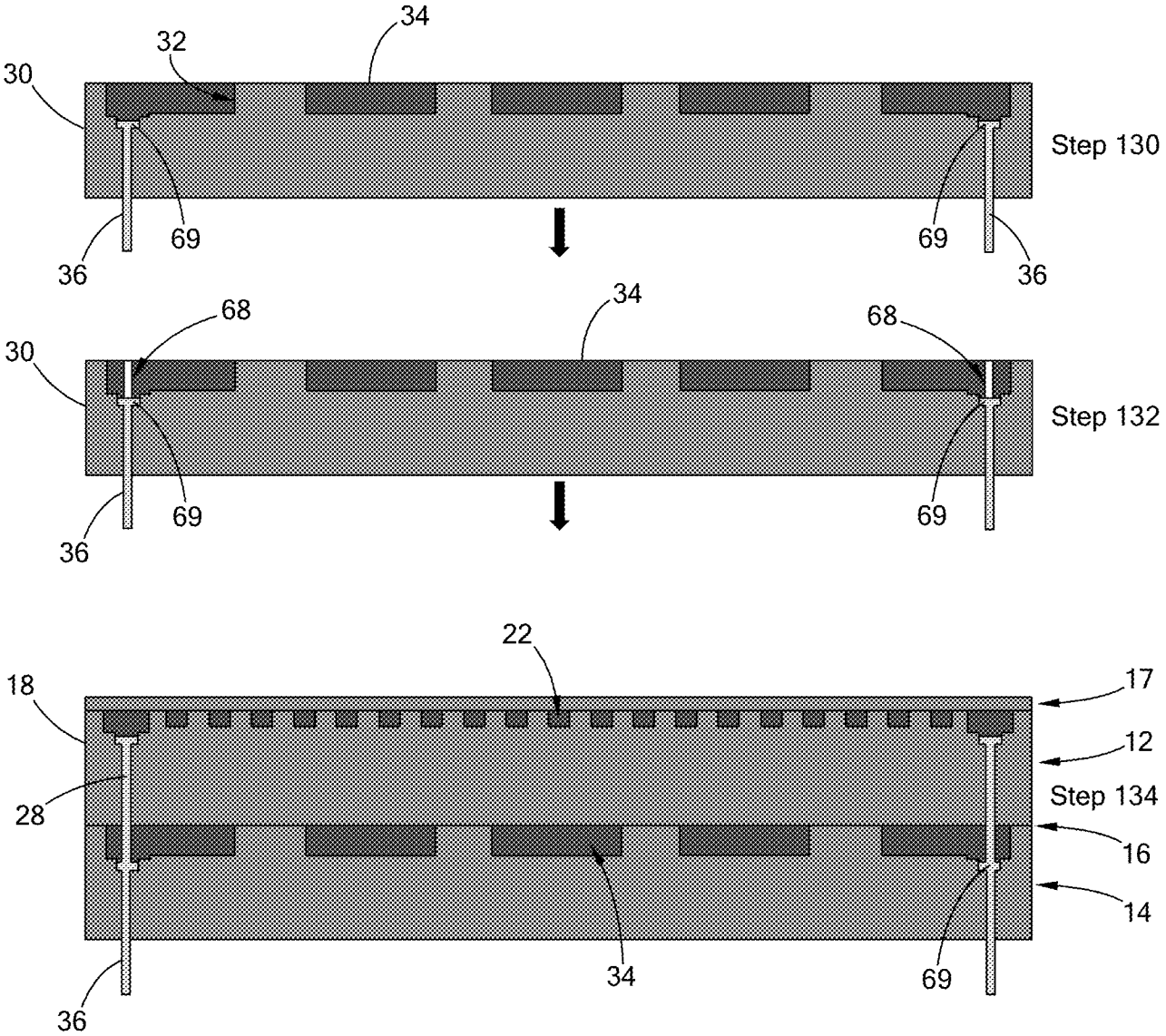
FIG. 2E is a diagram illustrating steps of manufacturing a routing layer of an electric heater of FIG. 1 in accordance with the teachings of the present disclosure.

Referring to FIGS. 2A through 2E, a method 100 of constructing an electric heater 10 of FIG. 1 includes a sub-process of manufacturing the heater layer 12 (as shown FIGS. 2A through 2D) and a sub-process of manufacturing the routing layer 14 (as shown in FIG. 2E), followed by bonding the heater layer 12 and the routing layer 14 together (also shown in FIG. 2E). The two sub-processes may be performed simultaneously or one after the other.

In the sub-process of manufacturing the heater layer 12, a substrate 18 in a blank form is provided in step 102. The substrate 18 has opposing first and second surfaces 40 and 42. A hard mask layer 46 is formed, such as by deposition, on the first surface 40 in step 104.

Next, a photo resist layer 48 is deposited on the hard mask layer 46 in step 106. The photo resist layer 48 is etched to form a photo resist pattern 50 on the hard mask layer 46 in step 108. In this step, a photo mask (not shown) for patterning the photo resist layer 48 is placed above the photo resist layer 48, and an ultraviolet (UV) light is applied onto the photo resist layer 48 through the photo mask to develop the portions of the photo resist layer 48 that are exposed to the UV light, followed by etching the exposed portion or the unexposed portions of the photo resist layer 48 to form the photo resist pattern 50. The photo resist pattern 50 may be a positive pattern or a negative pattern depending on whether the exposed or unexposed portions of the photo resist layer 48 are etched and removed.

Referring to FIG. 2B, the hard mask layer 46 is etched by using the photo resist pattern 50 as a mask to form a hard mask pattern 52 in step 110. Thereafter, the photo resist pattern 50 is removed, leaving the hard mask pattern 52 on the first surface 40 of the substrate 18 in step 112. The hard mask pattern 52 includes at least two enlarged openings 54.

Next, an etching process is performed on the first surface 40 of the substrate 18 by using the hard mask pattern 52 as a mask to form at least one trench 20 in the substrate 18 in step 114. The trench 20 defines a plurality of first trench sections 21 and at least two second trench sections 24 having enlarged areas. The at least two second trench sections 24 correspond to the at least two enlarged openings 54 of the hard mask pattern 52. The at least one trench 20 may be formed by a laser removal process, machining, 3D sintering/printing/additive manufacturing, green state, molding, waterjet, hybrid laser/water, dry plasma etching.

After the trench 20 is formed in the substrate 18, the hard mask pattern 52 is removed and the substrate 18 is cleaned to form a substrate 18 with a trench 20 with a desired trench pattern on the first surface 40 of the substrate 18 in step 116.

The number of the trenches 20 and the number of the enlarged second trench sections 24 depend on the number of heating zones of the resistive heating element 22 to be formed in the trench 20. The depth and width of the first and second trench sections 21 and 24 of the trench 20 depend on the desired function and performance of the resistive heating element 22. For example, when only one trench 20 is formed in the substrate 18, the trench 20 may have a constant or varied depth and/or width. When a plurality of trenches 20 are formed in the substrate 18, some of the trenches 20 may be wider and the others may be narrower; some of the trenches 20 may be deeper and the others may be shallower.

Referring to FIG. 2C, after the trench 20 with a desired trench pattern is formed in the substrate 18, a machining process is performed in each of the enlarged second trench sections 24 of the trench 20 to form a pad opening 62 and a via hole 64 through the substrate 18 in step 118. The pad opening 62 is disposed between the via hole 64 and the enlarged second trench section 24. The via hole 64 extends from the pad opening 62 to the second surface 42 of the substrate 18.

At step 120, a pair of terminal pins 28 are inserted into the via holes 64 and extend through the substrate from the pad opening 62 past the second surface 42 of the substrate 18. Each terminal pin 28 includes a terminal end 26 disposed in the pad opening 62 between the via hole 64 and the enlarged second trench section 24.

Thereafter, a resistive material 66 is deposited on the first surface 40 of the substrate 18 and in the trench 20 in step 122. As an example, the resistive material 66 may be formed on the substrate 18 and in the trench 20.

The resistive material 66 is thermally treated in step 124. As an example, the substrate 18 with the resistive material 66 disposed both in the trench 20 and on the first surface 40 of the substrate 18 may be placed in a furnace for annealing.

Referring to FIG. 2D, after the resistive material 66 is thermally treated, a chemical mechanical polishing/planarization (CMP) process is performed on the resistive material 66 to remove excess resistive material 66 until the first surface 40 of the substrate 18 is exposed, thereby forming a resistive heating element 22 in the trench 20 in step 126. In this step, the first surface 40 of the substrate 18 is exposed and not covered by any resistive material 66. The resistive material 66 remaining in the trench 20 forms the resistive heating element 22 having a top surface 67 flush with the first surface 40 of the substrate 18.

Finally, a protective layer 17 is formed on the first surface 40 of the substrate 18 and the top surface 67 of the resistive heating element 22 in step 128. The protective layer 17 electrically insulates the resistive heating element 22. The protective layer 17 may be formed on the substrate 18 by bonding a preformed protective layer to the substrate 18. The bonding process may be a brazing process or a glass frit bonding. Alternatively, when multiple trenches 20 are formed in the substrate 18, some of the trenches 20, preferably the trenches located around periphery of the substrate 18, may be filled with a bonding agent so that the bonding agent in some of the trenches 20 may bond the substrate 18 to the protective layer 17. After the protective layer 17 is formed on the substrate 18, a heater layer 12 is completed.

As previously described, the depth and width of the trench 20 may be configured to be varied along the length of the trench 20. With varied depth and width, the trench 20 allows the resistive heating element 22 to be formed with varied thickness and width along its length, thereby achieving variable wattage along the length of the resistive heating element 22. Moreover, by using the trench 20 to define the shape of the resistive heating element 22, it is possible to deposit different materials in different portions of the same trench, or to deposit two or more layers of materials in the same trench 20. For example, a resistive material may be deposited in the trench 20 first, followed by depositing a bonding agent on top of the resistive material. Therefore, the materials in the trench 20 can also be used as a bonding agent to bond a protective layer thereon. Engineered layers or doped materials may also be deposited in different portions of the trench 20 to achieve a resistive heating element having different material properties along its length.

Referring to FIG. 2E, the sub-process of manufacturing a routing layer 14 includes steps similar to the steps of the sub-process of manufacturing a heater layer 12 previously described except that the sub-process of manufacturing a routing layer 14 includes a step of machining a via hole through the routing material and does not include a step of bonding a protective layer. Moreover, since the heater layer 12 and the routing layer 14 have different function, the materials for forming the resistive heating element 22 and the routing element 34 are different.

More specifically, the sub-process of manufacturing the routing layer 14 includes steps similar to step 102 through step 126 as previously described in connection with FIG. 2A to FIG. 2D. Therefore, the detailed description of these steps are omitted herein for clarity. The material filling in the trench 32 of the routing layer 14 is different from the material filling in the trench 20 of the heater layer 12. The heater layer 12 is configured to generate heat and thus, the material that fills in the trench 20 of the substrate 18 is a resistive material having relatively high resistivity in order to generate heat. In the routing layer 14, the material that fills in the trench 32 of the substrate 30 is a conductive material having relatively high conductivity in order to electrically connect the resistive heating element 22 of the heater layer 12 to an external power source.

Moreover, the substrate 30 of the routing layer 14 has a trench 32 having a trench pattern different from that of the trench 20 of the substrate 18 of the heater layer 12. As shown in FIG. 2E, the trench 32 of the routing layer 14 is shown to be wider than the trench 20 of the heater layer 12.

Referring to FIG. 2E, the routing material is thermally treated and planarized to form a routing element 34 in step 130. In this step, the top surface of the substrate 30 is flush with the top surface of the routing element 34. Similar to the heater layer 12, the routing layer 14 includes a pair of terminal pins 36 and a pair of terminal ends 69 connected to at least two portions of the routing element 34.

Next, the routing element 34 is machined to define a pair of via holes 68 extending from a top surface of the routing element 34 to the terminal ends 69 in step 132. Thereafter, the heater layer 12 is placed on top of the routing layer 14 in step 134. The terminal pins 28 of the heater layer 12 that extend beyond the second surface 42 of the substrate 18 are inserted into the via holes 68 so that the terminal pins 28 of the heater layer 12 are in contact with the terminal end 69 of the routing layer 14. Therefore, the resistive heating element 22 of the heater layer 12 is electrically connected to the routing element 34, which in turn, is electrically connected to an external power source.

Figure 3:
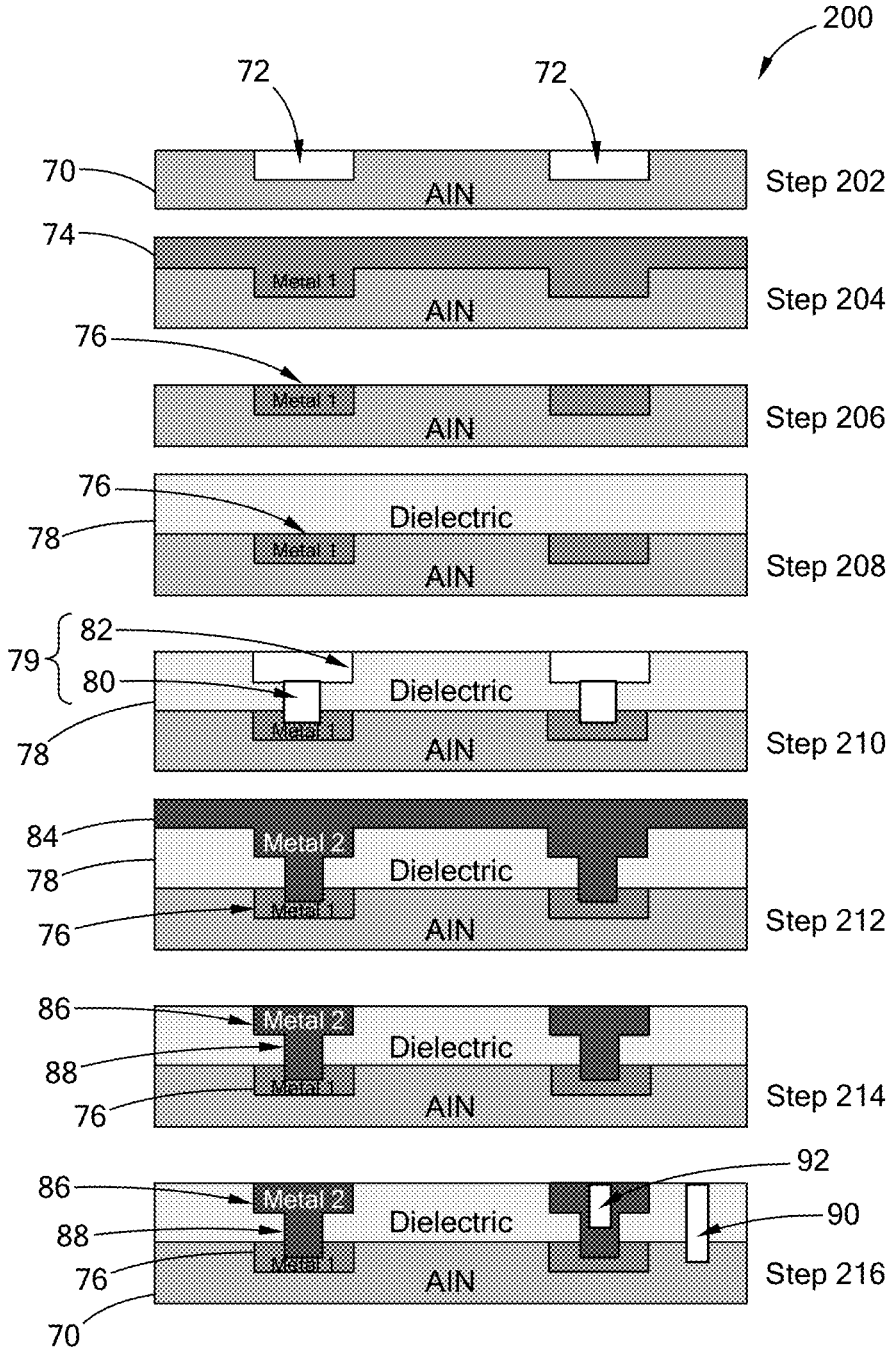
FIG. 3 is a diagram illustrating steps of a variant of a method of manufacturing an electric heater in accordance with the teachings of the present disclosure.

Referring to FIG. 3, a variant of a method 200 of manufacturing an electric heater in accordance with the teachings of the present disclosure is described. The method can be applied to form another electrical component, such as, an electrode layer of an electrostatic chuck, and an RF (Radio Frequency) antenna layer, depending on the type of functional material that fills in the trench of the substrate.

The method 200 starts with providing a substrate 70, and forming at least one trench 72 into the substrate 70 in step 202. The substrate 70 may include aluminum nitride. In this step, the at least one trench may be formed by a mechanical method, such as a laser removal/cutting process, micro bead blasting, machining, 3D sintering/printing/additive manufacturing, green state, molding, waterjet, hybrid laser/water, or dry plasma etching without using a hard mask pattern. When a micro bead blasting process is used, the particle size of the beads is less than 100 μm, preferably less than 50 μm.

Next, a first functional material 74, which includes a first metal, is filled in the trench 72 and on a top surface of the substrate 70 in step 204. The first functional material 74 may be formed by a layered process, which involves application or accumulation of a material to a substrate or another layer using processes associated with thick film, thin film, thermal spraying, or sol-gel, among others. Alternatively, the first functional material 74 may be deposited on the substrate 70 and in the trench 72 using a braze reflow process, as previously described in connection with step 122 of FIG. 2C. For example, the first functional material 74 may be formed by placing a metallic foil on the substrate 70, followed by melting the metallic foil so that the molten material may fill in the trench 72 and reflows to a top surface of the substrate.

Next, similar to step 124 described in connection with FIG. 2C, in step 204, the first functional material 74 may be thermally treated, such as by annealing. Thereafter, excess first functional material 74 is removed from the substrate 70 to thereby leave the first functional material 74 within the at least one trench 72 of the substrate 70 to form a first functional element 76 in step 206. The removing process may be a chemical-mechanical process (CMP), etching, or polishing. Then, a dielectric layer 78 is deposited over the first functional element 76 and over the substrate 70 in step 208.

Next, at least one via 79 is formed through the dielectric layer 78 at at least two corresponding locations to expose a portion of the first functional element 76 in step 210. The via 79 may include a via hole 80 and a trench 82. This step includes a step of forming a trench 82 in the dielectric layer 78, and a step of forming a via hole 80 through the dielectric layer 78 and into the first functional element 76. The trench 82 may be formed before or after the via hole 80 is formed. The via 79 may be formed by laser cutting. The trench 82 may have a depth in the range of approximately 100 nm to 100 μm.

A second functional material 84 is deposited into the via 79 including the via hole 80 and the trench 82 and a top surface of the dielectric layer 78 so that the second functional material 84 is in contact with the first functional element material 76 in step 212.

Excess second functional material 84 is removed from the dielectric layer 78, thereby leaving the second functional material 84 within the via 79 to form electrical terminations to the first functional element 76 in step 214. In this step, the second functional material 84 remaining in the trench 82 forms a second functional element 86. The top surface of the second functional material 84 after the removing step is flush with the top surface of the dielectric layer 78. Alternatively, the second functional material 84 may be etched to form a desired profile.

When the method 200 is used to form an electric heater, the first functional element 76 may be a resistive heating element and the second functional element 86 may be a routing element for connecting the resistive heating element to an external power source. When the method 200 is used to form an electrode layer of an electrostatic chuck, the first functional element 76 may be an electrode element and the second functional element 86 may by a routing element for connecting the electrode element to an external power source.

Alternatively, the first functional element 76 may be configured to be a routing element, whereas the second functional element may be configured to be a resistive heating element, or an electrode element. In this case, the via hole 80 may be filled with the same material of the first functional element 76 or a different material for a desired electrical conduction.

Thereafter and optionally, a first post hole 90 or a second post hole 92 may be formed in step 216. The first post hole 90 extends through the dielectric layer 78 and the underlying first functional element 76. The second post hole 92 extends through the second functional element 86. The first and second post holes 90 and 92 may be formed by a laser cutting process or a bead blasting process.

Additional terminal pins (not shown) may be inserted into the first post hole 90 and/or the second post hole 92 for connecting the first functional element 76 and/or the second functional element 86 to another electrical component, such as another heater layer, a tuning layer, a temperature sensing layer, a cooling layer, an electrode layer, and/or an RF antenna layer. As a result, the additional heater layer, tuning layer, cooling layer, electrode layer, or RF antenna layer can be connected to the same routing element and to an external power source. The additional heater layer, tuning layer, cooling layer, electrode layer, RF antenna layer may be manufactured by the methods 100 or 200 described in connection with FIGS. 2A to 3.

With respect to the method 100 disclosed in connection with FIGS. 2A to 2E, while the method of the present disclosure has been described to include sub-processes of manufacturing the heater layer 12 and the routing layer 14, the method 100 may include additional one or more sub-processes of manufacturing additional one or more electrical component using similar steps. For example, the method 100 may further include a sub-process for manufacturing another heater layer, tuning layer, a cooling layer, an electrode layer, and RF antenna layer, etc.

Alternatively, the sub-process of manufacturing the heater layer 12 may be used to form another electrical component by filling a different material in the trench. For example, a cooling layer may be formed if a Peltier material fills in the trench of the substrate. An electrode layer for an electrostatic chuck may be formed if an electrode material fills in the trench. An RF antenna layer may be formed if a suitable RF antenna material fills in the trench. A thermal barrier layer may be formed if a material with relatively low thermal conductivity fills in the trench. A thermal spreader may be formed if a material with relatively high thermal conductivity fills in the trench.

The electric heater 10 manufactured by the methods 100, 200 of the present disclosure has an embedded heating circuit and an embedded routing circuit, and a plurality of functional layers that are more planar throughout the substrate. Therefore, the electric heater can have a more uniform structure and more uniform heating performance.

Figure 4:
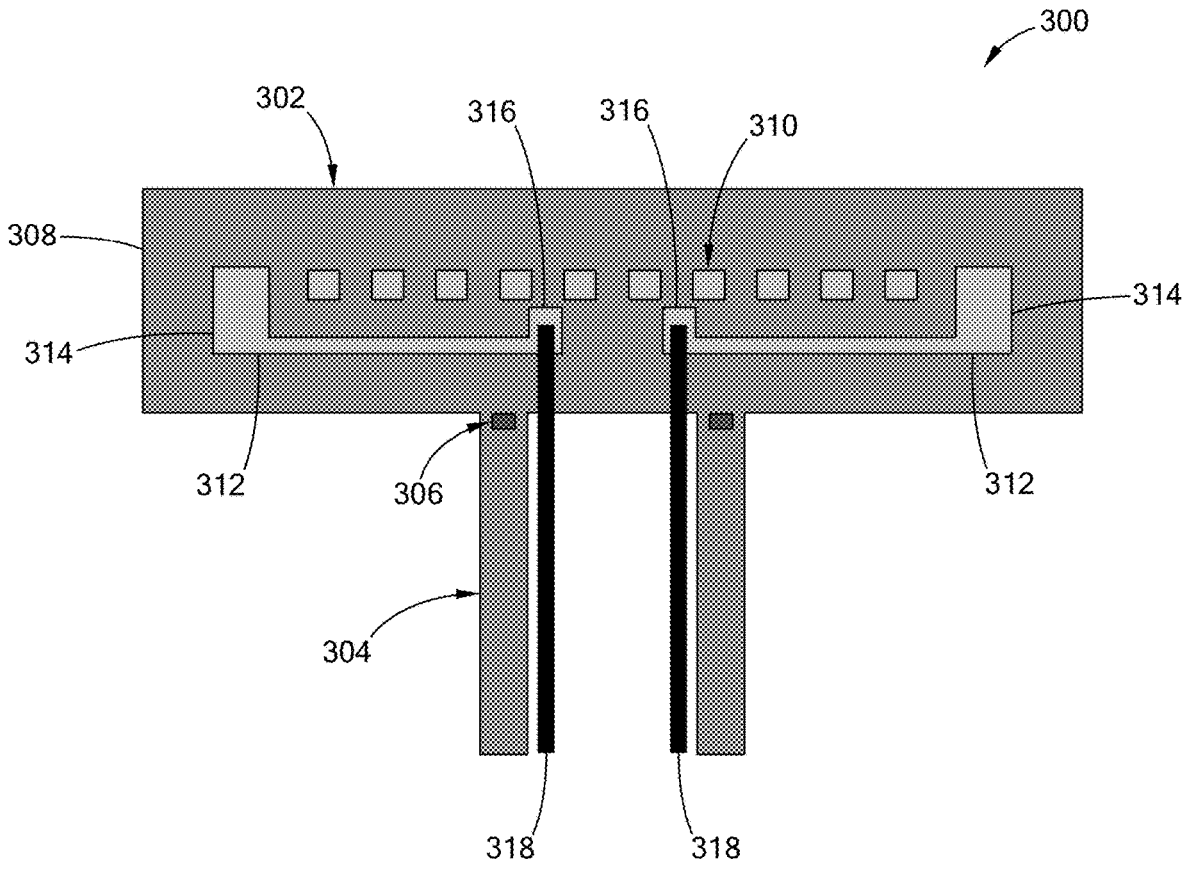
FIG. 4 is a cross-sectional view of a support pedestal including an electric heater constructed in accordance with the teachings of the present disclosure.

Referring to FIG. 4, a support pedestal 300 constructed in accordance with the teachings of the present disclosure includes a plate assembly 302 and a tubular shaft 304 bonded to the plate assembly 302 via a bonding feature 306. The support pedestal 300 is configured to support a wafer thereon in semiconductor processing. The plate assembly 302 may be in the form of an electric heater, an electrostatic chuck or any device that includes a ceramic substrate and a functional element embedded in the ceramic substrate.

In the illustrative form, the plate assembly 302 is an electric heating plate and includes a ceramic substrate 308, a resistive heating element 310, and a routing element 312. The resistive heating element 310 and the routing element 312 are embedded in the ceramic substrate 308. The ceramic substrate 308 is a monolithic substrate formed by hot pressing and may be made of a ceramic material, such as aluminum nitride (AlN) and aluminum oxide ($Al_2O_3$). The plate assembly 302 further includes a plurality of first termination portions 314 for electrically connecting the resistive heating element 310 to the routing element 312, and a pair of second termination portions 316 disposed adjacent to a central portion of the routing element 312. A pair of lead wires 318 are connected to the second termination portions 316 and extend inside the tubular shaft 304 for connecting the routing element 312 to an external power supply (not shown). The number of the first termination portions 314 depend on the number of heating zones defined by the resistive heating element 310.

The resistive heating element 310 is made of a resistive material having relatively high resistivity, such as one selected from the group consisting of molybdenum, tungsten, platinum, or alloys thereof, in order to generate heat. In addition, the resistive material of the resistive heating element 310 may have sufficient temperature coefficient of resistance (TCR) characteristics such that the resistive heating element 22 functions as a heater and as a temperature sensor. The routing element 312 is made of a conductive material having relatively high conductivity to electrically connect the resistive heating element 310 to an external power source.

It is understood that when the plate assembly 302 is formed as an electrostatic chuck, an electrode element, in place of the resistive heating element, may be formed.

Referring to FIGS. 5A to 5D, a method 400 of manufacturing the support pedestal 300 is depicted. The method 400 starts with placing a plurality of slugs within a hot isostatic press chamber 450 and aligning the plurality of slugs with the chamber tooling (not shown) in step 402. The plurality of slugs may include a plurality of first slugs 452 and a pair of second slugs 454. The second slugs 454 have a smaller length than the first slugs 452 and are disposed adjacent to a central portion of the hot isostatic press chamber 450. The first and second slugs 452, 454 will be formed into the first and second termination portions 314, 316 (shown in FIG. 4), respectively, in subsequent steps.

Next, the hot isostatic press chamber 450 (only shown in step 402) is filled with ceramic powder 455, such as AlN powder, in step 404. Then, the ceramic powder 455 and the first and second slugs 452, 454 undergo a hot pressing process in the hot isostatic press chamber 450 to form a sintered assembly 456 in step 406. Hot pressing is known as a high-pressure, low-strain-rate powder metallurgy process for forming a powder compact at a temperature high enough to induce sintering and creep processes. This is achieved by simultaneous application of heat and pressure. In the sintered assembly 456, the first and second slugs 452, 454 are pressed, sintered, and embedded in a ceramic substrate 457. The sintered assembly 456 has a first surface 458 and a second surface 460. The first slugs 452 extend from the first surface 458 to the second surface 460 and are exposed from the first and second surfaces 458 and 460. The second slugs 454 are exposed to only the second surface 460. Lapping may be applied on the sintered assembly 456 to achieve a high level of surface flatness and parallelism.

Figure 5A:
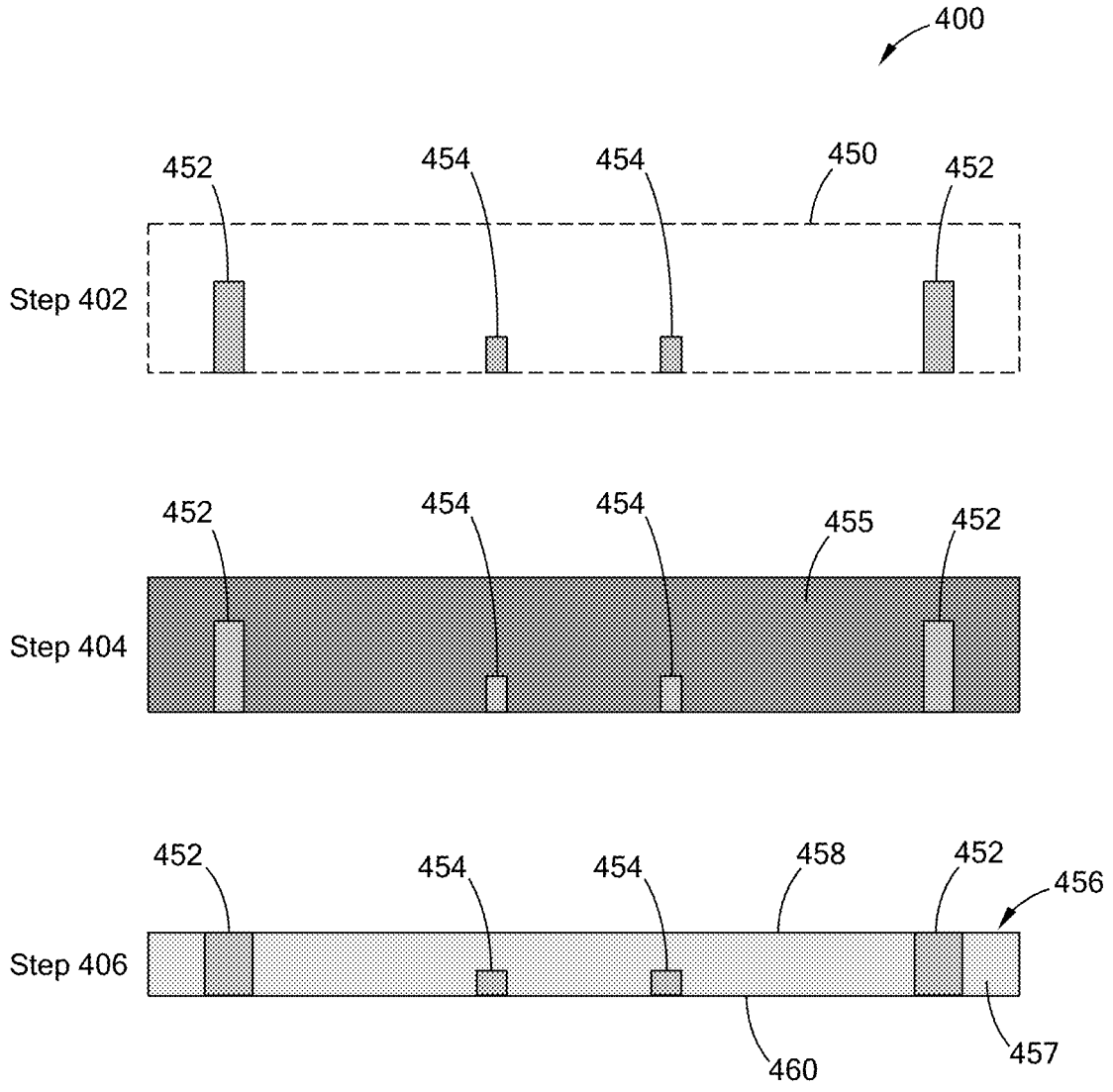
FIG. 5A through 5D are diagrams illustrating steps of manufacturing the support pedestal of FIG. 4 in accordance with the teachings of the present disclosure.
Figure 5B:
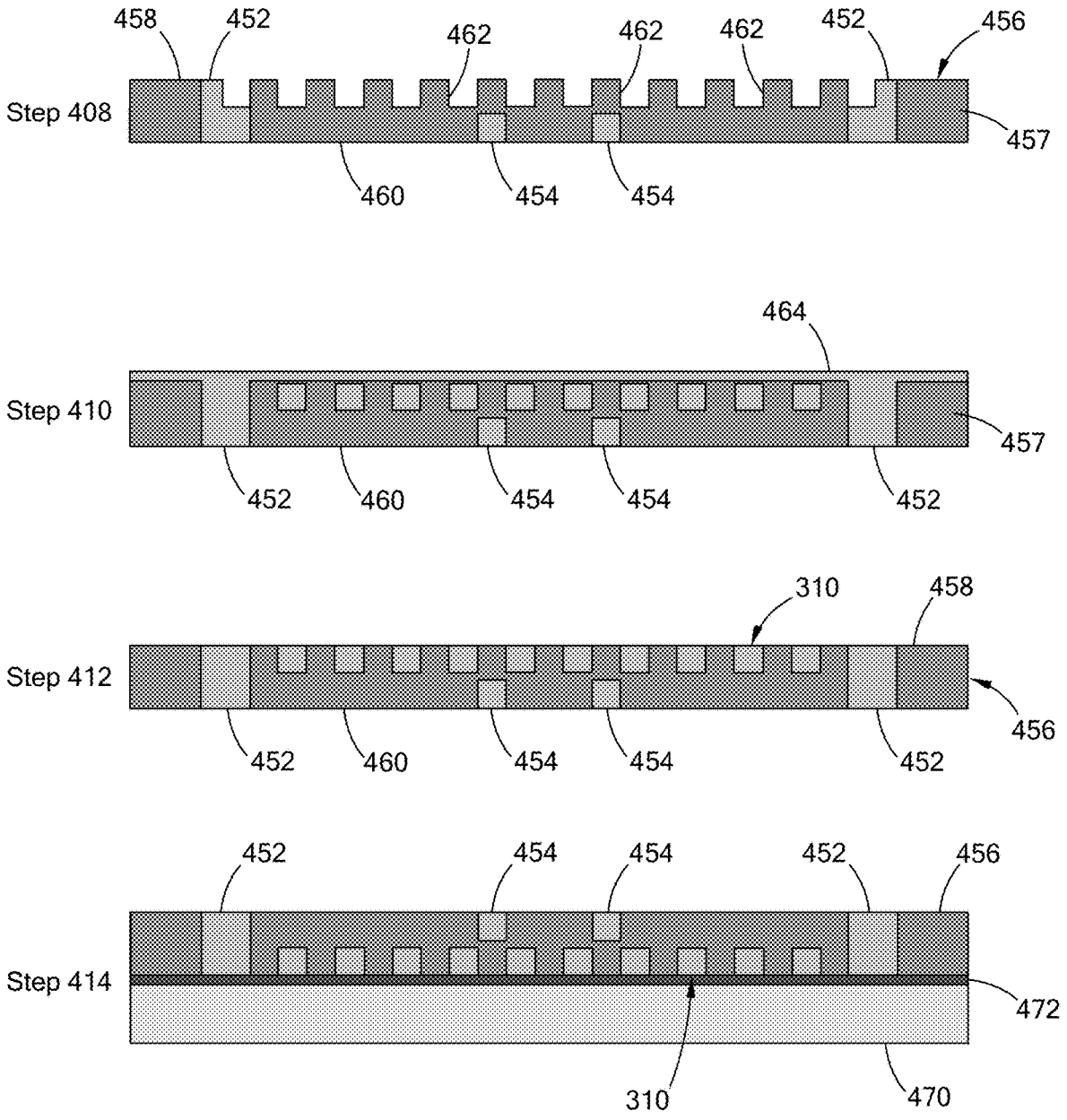

Referring to FIG. 5B, at least one trench 462 is formed in the sintered assembly 456 in step 408. The trench 462 is formed along the first surface 458 and formed into the first slugs 452. The trench 462 may have a serpentine configuration in the plan view. The at least one trench 462 may be formed by a mechanical method, such as a laser removal/cutting process, micro bead blasting, machining, 3D sintering/printing/additive manufacturing, green state, molding, waterjet, hybrid laser/water, or dry plasma etching. The trench 462 does not extend into the second slugs 454. When a plurality of heating zones are desired, a plurality of trenches 462 are formed in order to form a plurality of resistive heating elements 310 corresponding to the plurality of heating zones.

Next, a functional material 464 is applied on the first surface 458 of the sintered assembly 456 to fill the trench 462 and to cover the entire first surface 458 in step 410. The functional material 464 may be applied by deposition or sputtering, or any conventional methods. Alternatively, the functional material 464 may be formed by a layered process, which involves application or accumulation of a material to a substrate or another layer using processes associated with thick film, thin film, thermal spraying, or sol-gel, among others. Alternatively, the functional material 464 may be deposited on the sintered assembly 456 and in the trench 462 using a braze reflow process. For example, the functional material 464 may be formed by placing a metallic foil on the first surface 458 of the sintered assembly 465, followed by melting the metallic foil so that the molten material may fill in the trench 462 and reflows to the first surface 458 of the sintered assembly 456.

The functional material 464 may be a resistive material having relatively high resistivity, such as molybdenum, tungsten, platinum, or alloys thereof. If an electrostatic chuck is desired, the functional material 464 may be a material suitable for an electrode. Next, a planarization process is performed on the functional material 464 to remove excess functional material until the first surface 458 is exposed, thereby forming a functional element in the trench 20 in step 412. In this form, the functional element is a resistive heating element 310, which is connected to the first slugs 452. The planarization process may be a chemical mechanical polishing/planarization (CMP) process, etching, polishing.

Thereafter, a sintered substrate part 470 is placed in the hot isostatic press chamber 450 and the sintered assembly 456 is placed on top of the sintered substrate part 470 with the resistive heating element 310 disposed adjacent to the sintered substrate part 470 in step 414. Alternatively, instead of using a sintered substrate part 470, another sintered assembly with another functional element embedded therein may be used to be bonded to the sintered assembly 456 depending on applications. Optionally, a mixture 472 of AlN powder and sintering aide may be applied between the sintered assembly 456 and the sintered substrate part 470 to facilitate bonding the sintered assembly 456 to the sintered substrate part 470.

Figure 5C:
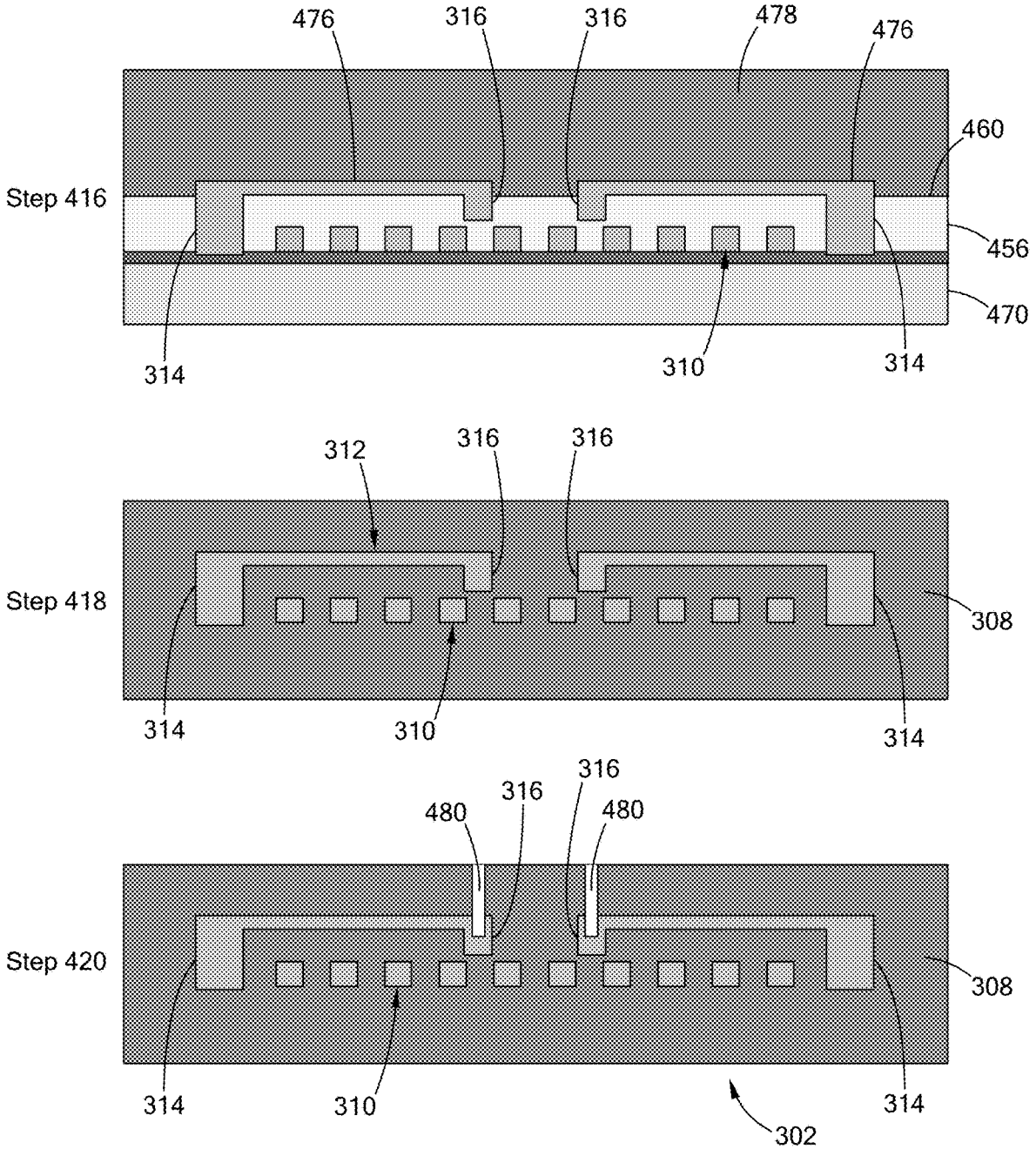
Figure 5D:
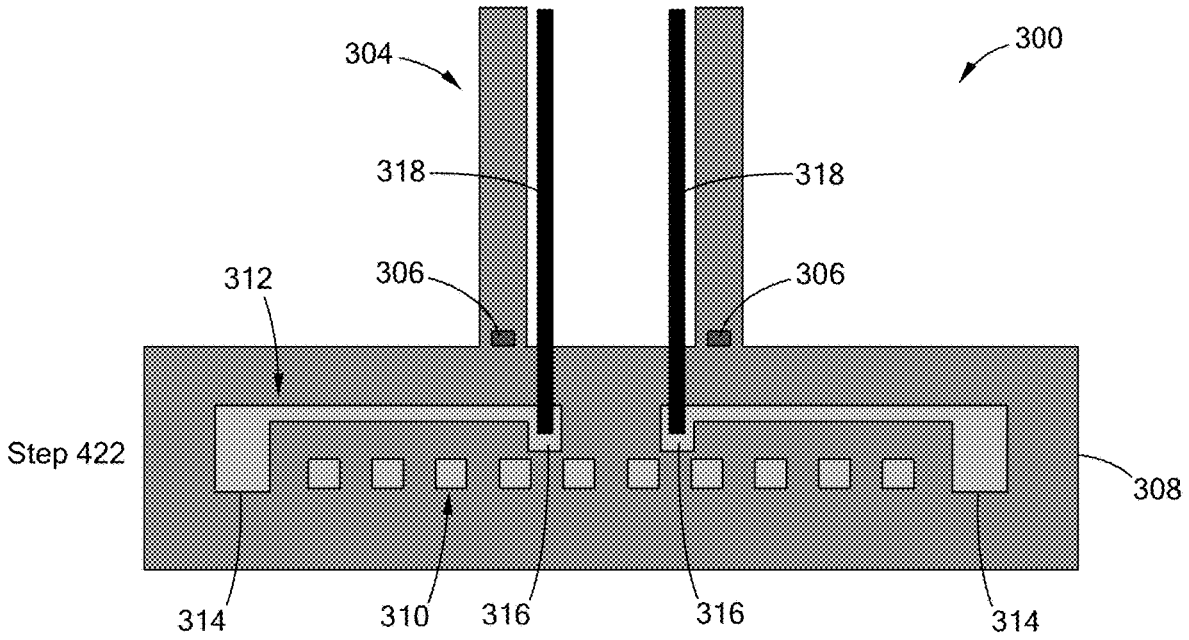

Referring to FIG. 5C, a material layer 476 is formed on the second surface 460 of the sintered assembly 456 to connect the first slugs (which become the first termination portions 314) to the second slugs (which become the second termination portions 316) in step 416. The material layer 476 may be in the form of a foil and placed on top of the second surface 460, or may be formed on the second surface 460 by deposition. The material layer 476 has a thickness of approximately 5 mil (0.127 mm). After the material layer 476 is formed on the second surface 460 of the sintered assembly 456, the isostatic press chamber 450 is filled with another mixture 478 of AlN powder and sintering aide.

Next, the sintered assembly 456, the sintered substrate part 470, and the mixture 478 of AlN powder and sintering aid undergo the hot pressing process in the isostatic press chamber 450 in step 418. A single monolithic substrate 308 is thus formed, with the resistive heating element 310, the routing element 312 (i.e., the material layer 476), the first and second terminations 314, 316 (i.e., the first and second slugs 452, 454) embedded therein.

Next, holes 480 are drilled through the monolithic ceramic substrate 308 to allow access to the second termination portions 316 in step 420.

Finally, lead wires 318 are inserted in the holes 480 and bonded to the second termination portions 316 and a tubular shaft 304 is bonded to the monolithic ceramic substrate 308 by a bonding feature 306 to complete the support pedestal 300 in step 422.

The bonding feature 306 may include a trench, which is filled with an aluminum material to facilitate bonding of the tubular shaft 304 to the plate assembly 302. The bonding feature has been described in a co-pending application assigned to the present Applicant, i.e., U.S. Ser. No. 15/955,431, field Apr. 17, 2018 and titled "Ceramic-Aluminum Assembly with Bonding Trenches," the content of which is incorporated herein in its entirety for reference.

In this form, no via hole needs to be formed through the ceramic substrate. The resistive heating element 310 is connected to the routing element 312 by the first termination portions in the form of slugs. The routing element may be a metal foil. Therefore, a wide selection of materials are available for forming the routing element and the first termination portions in order to provide good electric conductivity with reduced resistance. By forming a trench to receive the functional material, the resistive heating element can be made very thin to increase the resistance of the resistive heating element.

It should be noted that the disclosure is not limited to the form described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A heater assembly comprising:

a substrate having a first surface and a second surface opposing the first surface, the substrate defining at least one trench on the first surface and a pair of via holes extending from the at least one trench and through the substrate;

a functional element disposed inside the at least one trench and being flush with the first surface of the substrate; and a pair of terminal pins disposed in the pair of via holes.

2. The heater assembly according to claim 1, wherein the pair of via holes extend from a bottom of the at least one trench to the second surface of the substrate.

3. The heater assembly according to claim 1, wherein the at least one trench includes at least two enlarged trench sections, wherein the pair of via holes extend from the two enlarged trench sections of the at least one trench to the second surface of the substrate.

4. The heater assembly according to claim 1, wherein the pair of terminal pins extend beyond the second surface of the substrate.

5. The heater assembly according to claim 1, further comprising a routing element disposed at the second surface of the substrate for connecting the terminal pins to an external power source.

6. The heater assembly according to claim 5, further comprising a bonding layer for bonding the routing element to the substrate.

7. The heater assembly according to claim 1, further comprising a routing layer including another substrate, a routing element on the another substrate, and another pair of terminal pins, wherein the routing layer is bonded to the second surface of the substrate.

8. The heater assembly according to claim 7, wherein the routing element is flush with a surface of the another substrate of the routing layer.

9. The heater assembly according to claim 7, wherein the another pair of terminal pins of the routing layer are aligned with the pair of terminal pins.

10. The heater assembly according to claim 1, wherein the functional element is a resistive heating element.

11. The heater assembly according to claim 10, wherein the resistive heating element has a resistive material selected from a group consisting of molybdenum, tungsten, platinum and their alloys.

12. The heater assembly according to claim 1, wherein the substrate is made of a ceramic material.

13. The heater assembly according to claim 1, wherein at least one trench has a varied depth or a varied width along a length of the at least one trench.

14. A heater assembly comprising:

a heater layer including a first substrate, a functional element, and a pair of first terminal pins extending through the first substrate, wherein the first substract defines a first trench at a first surface, the functional element being flush with the first surface of the first substrate;

a routing layer including a second substrate and a routing element; and a bonding layer disposed between the heater layer and the routing layer for bonding the heater layer to the routing layer.

15. The heater assembly according to claim 14, wherein the pair of first terminal pins extend beyond a second surface of the first substrate and are connected to the routing element.

16. The heater assembly according to claim 14, wherein the routing layer includes a pair of second terminal pins aligned with the pair of the first terminal pins.

17. The heater assembly according to claim 16, wherein the pair of first terminal pins are connected to the pair of second terminal pins.

18. The heater assembly according to claim 14, wherein the first substate defines a pair of first via holes extending from a bottom of the first trench of the first substrate to the second surface of the first substrate.

19. The heater assembly according to claim 18, wherein the second substrate defines a second trench and a pair of second via holes extending from the secone trench and through the second substrate, wherein the routing element is disposed in the second trench.

20. The heater assembly according to claim 14, wherein one of adjacent surfaces of the heater layer and the routing layer defines a peripheral trench, wherein a bonding agent is disposed in the peripheral trench for bonding the heater layer to the routing layer.

* * * * *